US006469885B1

(12) United States Patent
Mohler

(10) Patent No.: US 6,469,885 B1
(45) Date of Patent: Oct. 22, 2002

(54) POWER SAVING CIRCUIT FOR SOLENOID DRIVER

(75) Inventor: David B. Mohler, Tipp City, OH (US)

(73) Assignee: Impact Devices Incorporated, West Carrollton, OH (US)

( * ) Notice: Subject to any disclaimer, the term of this patent is extended or adjusted under 35 U.S.C. 154(b) by 0 days.

(21) Appl. No.: 09/504,930

(22) Filed: Feb. 16, 2000

(51) Int. Cl.[7] ..... H01H 47/32; F02M 51/00
(52) U.S. Cl. ..... 361/160; 123/490
(58) Field of Search ..... 361/160, 152, 361/194, 205, 154, 98, 101, 155; 123/490

(56) References Cited

U.S. PATENT DOCUMENTS 4,589,401 A * 5/1986 Karim et al. ..... 123/479
4,599,548 A * 7/1986 Schultz ..... 318/599
4,729,056 A * 3/1988 Edwards et al. ..... 361/153
4,941,348 A * 7/1990 Hock ..... 73/119 A
5,053,911 A * 10/1991 Kopec et al. ..... 361/154
5,173,832 A * 12/1992 Giorgetta et al. ..... 361/88
5,222,011 A * 6/1993 Braun ..... 361/154
5,251,091 A * 10/1993 Ito et al. ..... 361/152
5,442,515 A * 8/1995 Wallaert ..... 361/187

* cited by examiner

*Primary Examiner*—Rajnikant B. Patel
(74) *Attorney, Agent, or Firm*—Nixon & Vanderhye P.C.

(57) ABSTRACT

An electronic driver circuit for reducing power consumed by a solenoid operated device. The end of the solenoid operating stroke or the existence of suitable kinetic energy in a solenoid armature is measured by reference to current flow through the solenoid coil. Current flow through the solenoid coil is subsequently terminated so as to avoid further power waste which is not contributing to any desirable increase in armature kinetic energy. In a preferred embodiment, the magnetic flux built up in the solenoid coil is applied through a suitable diode network back to the power supply, thereby reducing further the power requirements for solenoid operation.

30 Claims, 3 Drawing Sheets

POWER SAVING CIRCUIT FOR SOLENOID DRIVER

BACKGROUND OF THE INVENTION

1. Field of the Invention

The present invention generally relates to power saving circuits and specifically relates to a power saving circuit for solenoid drivers, especially those which are battery powered.

2. Description of the Prior Art

Solenoids are comprised in their simplest form of a coil and an armature which is free to move within the coil. The armature is normally spring loaded away from the energized position such that when a power pulse is applied to the coil, the armature is pulled into the energized position and in moving can do useful work. It is known that once the solenoid has moved to the end of its operating stroke, no further work will be done by the armature.

Because the amount of current flow through the coil determines the strength of the magnetic field acting upon the armature and the voltage applied to the coil determines the current flow through the coil, a battery which has been recently recharged or exchanged for a fresh battery will cause the greatest magnetic field acting on the armature. Generally however, toward the end of the useful life of a battery, the voltage is at a minimum, the coil's magnetic field is at a minimum and the acceleration of the armature is less. As a result, the duration of voltage application to the coil must be sufficiently long in order to permit the armature, accelerating at a slower rate, to complete its operating stroke. Thus, with a fixed duration voltage pulse applied to the coil, a relatively longer duration is required. Unfortunately, when the battery is freshly charged or new, the time needed for completion of the operating stroke is substantially less than the fixed duration needed for the weakest battery in order to complete the desired solenoid motion. Thus, with a fresh battery, after the operating stroke has been completed, the coil. due to the longer duration pulse, continues to be energized, thereby wasting battery power.

One preferred application of battery powered solenoids is as a Braille impact printer. The solenoid's operating stroke is utilized to drive a pin which impacts and embosses a paper target so as to produce Braille characters readable by touch. The solenoid's function, therefore, is to produce enough impact energy on the target to suitably emboss the target such that the impact can be "read" by feel.

For portable Braille printers small enough for a student to carry and use in a classroom, the weight and size must be minimized. As a result, the battery size and its energy storage capacity is limited. Efficiencies in the solenoid driver circuit are magnified because the battery capacity is generally required to operate up to six solenoid impacts to form each Braille character. A Braille character embodies a matrix of embossments that are three vertical spots by two horizontal spots.

If the average Braille character requires three solenoid impacts and the average Braille word length is 4.2 letters long (this includes punctuation characters), and a desirable word quantity between battery charges is approximately 8000, it will be seen then that a total of 100,800 solenoid impacts will be required per battery charge. The total battery energy consumed by the solenoid is a multiplication of the battery voltage, the solenoid current, the on time of the electrical pulse and the number of pulses supplied to the solenoid.

In conventional Braille printers, the duration of the electrical pulse is set, for example, to be 10 milliseconds long in order to permit sufficient embossment energy when the battery is at its lowest usable voltage. However, with the fresh battery (and the resultant increased acceleration and reduced operating stroke) the embossment function can be performed in 6 milliseconds. As a result 4 milliseconds (or 40%) of the consumed energy is wasted (generally as heat) in coil "on" time when the operating stroke has been completed where a fixed pulse duration of 10 milliseconds is employed by the electronic driver circuit.

SUMMARY OF THE INVENTION

It is therefore an object of the present invention to control energization pulses applied to a solenoid coil so as to reduce energy consumed.

It is another object of the present invention to provide a solenoid coil energizing pulse which terminates at about the end of the operating stroke of the solenoid.

It is a further object of the present invention to recover energy which is stored in the magnetic flux created by the solenoid coil and store this otherwise wasted energy.

The above and other objects are achieved in accordance with the present invention by sensing the current flow through the solenoid coil and when the current rises above the current demand during the operating stroke as when the armature ceases its movement, current flow to the coil is cut off. Current flow to the coil can be sensed by placing a small resistor in series with the coil and current flow through that coil can be controlled by one or more power transistors also in series with the coil. In one embodiment, a microprocessor is programmed to monitor the solenoid coil current flow such that when an inflection point is reached (indicating completion of the armature's operating stroke), current flow through the coil can be terminated. In another embodiment, because after termination of the operating stroke, coil current will rise above the maximum during the operating stroke, when the sensed coil current increases above the operating stroke maximum current flow is terminated. In a further preferred embodiment, the utilization of power transistors to isolate the coil permits diodes to provide current induced in the coil during the collapsing magnetic field (after the power transistors have been turned off) to be conveyed back to the battery, thereby saving battery power which would otherwise be lost.

BRIEF DESCRIPTION OF THE DRAWINGS

The present invention will be more thoroughly appreciated by reference to the appended drawings in which.

DETAILED DESCRIPTION OF PREFERRED EMBODIMENTS

The present invention is described hereinbelow with reference to a number of figures in which similar elements are designated with the same or similar numbers throughout the several views.

Figure 1:
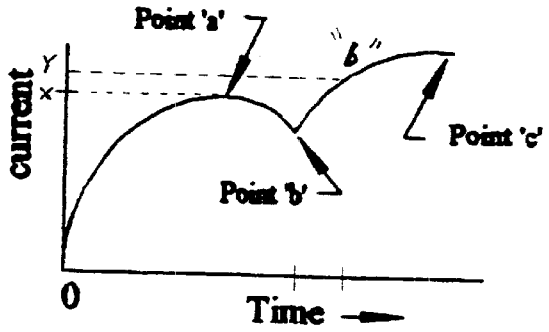
FIG. 1 is a graph of solenoid coil current versus time from initial pulse application until well after completion of the operating stroke.

It is known that the current flow through a solenoid is dependent upon the resistance and windings of the coil, the applied voltage, the size of the armature and its operating stroke. With the coil and armature characteristics fixed, as shown in FIG. 1 immediately after time "0," the application of supply voltage to the coil results in an increase in the current passing through that coil as the magnetic field of the coil increases. The rising magnetic field begins to accelerate the armature through its operating stroke.

However, the motion of the armature in the magnetic field induces in the coil a voltage that is in opposition to that of the applied voltage (also known as "back EMF"). This opposition voltage limits the rate of rise of the current and can even cause a current decrease. The current decrease, during the operating stroke of the armature, is shown between points 'a' and 'b' in FIG. 1.

As shown in FIG. 1 at point 'b', the solenoid armature has reached the end of its operating stroke (in the preferred embodiment used in the Braille printer, an embossing pin attached to the armature has completed the embossment of the paper). Because there is no further opposition voltage ("back EMF") being generated by movement of the armature, the current in the coil again begins to rise. The current rises in an exponential fashion to a steady state value indicated as point 'c' which current level is a function of the self-inductance of the coil, the internal resistance of the coil and the battery voltage.

Figure 3:
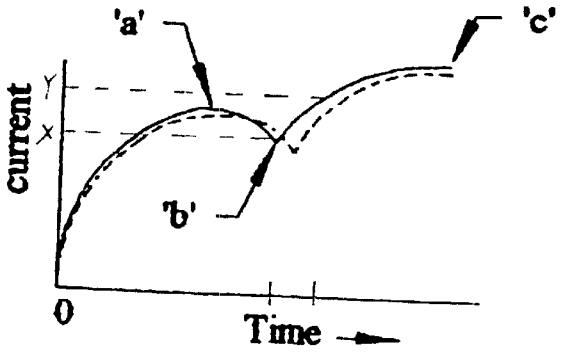
FIG. 3 is a graph of solenoid coil current versus time for an increase in battery voltage applied to the coil as compared to the graph of FIG. 1.

It can be readily understood that the time from point 0 to point 'b' will be shortened if the voltage applied to the coil is increased, as this increase in voltage increases the rate of increase of the magnetic field which in turn increases the magnetic force on the armature which, in accordance with Newton's laws of motion, accelerates the armature at a slightly faster pace. As shown in FIG. 3, a higher applied voltage results in a slight increase in acceleration of the armature with the armature completing its operating stroke in a shorter period of time. The higher applied voltage will also result in a slightly higher current flow through the coil, both during the operating stroke (from time 0 to time 'b') and after completion of the operating stroke (between time 'b' to 'c'). The higher voltage applied is shown in solid line and the original applied voltage of FIG. 1 is shown in dashed line.

Figure 2:
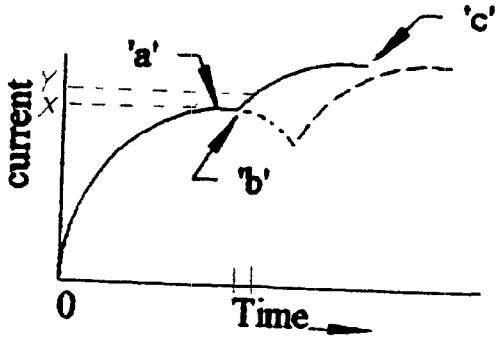
FIG. 2 is a graph of solenoid coil current versus time for a shortened stroke solenoid as compared to the graph of FIG. 1.

The time to complete the operating stroke can also be reduced if the operating stroke is shortened, as shown in FIG. 2, where the end of the operating stroke is indicated at 'b' which, because there is no more movement of the armature, also shortens the overall time necessary to reach the steady state current flow through the coil at point 'c.' As in FIG. 3, FIG. 2 illustrates the original current versus time graph of FIG. 1 in dashed lines with the FIG. 2 graph in solid lines.

It will be noted with respect to the current flow through the coil shown in each of FIGS. 1–3, that upon completion of the operating stroke, there is an inflection point at point 'b' in which the slope of the current versus time curve makes a substantial change. In FIGS. 1 and 3, it changes from sharply decreasing to sharply increasing and in FIG. 2, it changes from essentially steady state to sharply increasing.

This inflection point can be sensed directly by accurately measuring the change in current with respect to time or can be approximated by sensing a current flow greater than the maximum current achievable during the operating stroke. For example, in FIG. 1, the maximum current during the operating stroke (movement of the armature between time "0" and time 'b') is shown as value X. For a given battery voltage, a suitable value Y is chosen which is just slightly greater than X. Thus, even though value Y is not the inflection point 'b,' since it indicates a current flow greater than the operating stroke maximum current flow, its time "b" can be assumed to be just after the inflection point 'b.' Since it is reasonably close to the inflection point, "b" can be considered to be an approximation of the inflection point. The approximation of the inflection point at time "b" will occur slightly later in FIGS. 1, 2 and 3 than the actual inflection point time 'b.'

Figure 4:
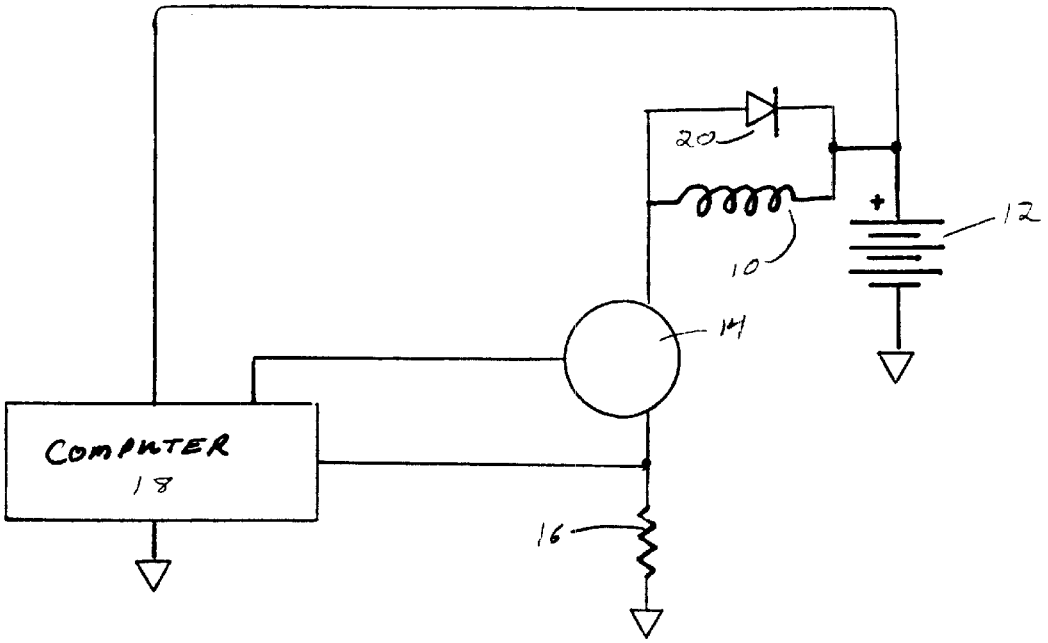
FIG. 4 is an electrical circuit diagram illustrating a microprocessor implemented embodiment of the present invention.

FIG. 4 illustrates one embodiment of the present invention which operates upon the inflection point 'b' and thus provides the most current saving. In series with the coil 10 and battery 12 is a power transistor 14 and a sensing resistor 16. It will be seen that all current traveling through coil 10 must pass through power transistor 14 and sensing resistor 16. It is desirable to make the sensing resistor a very low value of resistance so that the voltage drop across this resistor will be relatively small and the maximum voltage can be impressed across the solenoid coil 10.

A computer 18 having a conventional internal clock will initiate the solenoid action by applying a voltage pulse to the control base of power transistor 14 driving it into conduction and allowing current to begin flowing through coil 10. Because of the changing current flow through sensing resistor 16, a changing voltage drop across the resistor occurs which is sensed by the computer 18 as indicative of the changing current flow through the coil. The resistor 16 and the computer 18 comprise in a broad sense a sensing circuit When the armature completes its operating stroke, the current flow through the coil is as indicated at inflection point 'b.' The change in slope (of current versus time) is sensed by the computer 18 which changes polarity on the control base of the power transistor 14 thereby cutting off current flow through the transistor and thus the coil 10. In a broad sense the power transistor 14 comprises an interrupt circuit. Inasmuch as no further current flow can pass through transistor 14, the built-up magnetic flux created by the original current flow through the coil begins to collapse.

The collapsing magnetic field tends to maintain the current flow in the same direction through the coil as long as it is collapsing. This creates a voltage across the coil that is opposite to the originally applied voltage and, therefore, diode 20 permits this current flow caused by the collapsing magnetic field in the solenoid coil to be expended into heat in diode 20 and the resistance of the coil.

As a result of the circuitry shown in FIG. 4, however, regardless of the battery voltage, upon completion of the operating stroke of the solenoid armature (or earlier if sufficient kinetic energy is accumulated in the armature), current flow through the coil will be terminated, thereby saving the power represented by current flow to the right of inflection point 'b' in FIGS. 1–3. Thus, regardless of where the inflection point is located and regardless of the solenoid stroke and regardless of the battery voltage, the computer can sense completion of the operating stroke (or the sufficiency of the armature's kinetic energy and terminate the drain on the battery, thereby saving a significant portion of the battery's energy.

While the computer may also be powered by battery 12 (or its own internal battery), it can monitor the battery voltage and lengthen the power pulse as necessary to ensure that the armature energy is uniform, whether new or old batteries are being utilized. For example, the application of battery power can be interrupted prior to completion of the operating stroke if the computer 18 senses that energy applied (energy is a function of the product of current and voltage and time) is sufficient to generate the necessary armature kinetic energy. However, as the battery power is consumed by repeated operation, the battery voltage and current will decrease and the duration of voltage applied to the coil will necessarily increase if the armature is to have the same kinetic energy when it strikes the paper to effect the desired embossing step.

In other words in a preferred embodiment, the computer may, with a fresh solenoid operating battery, terminate the power applied to the coil prior to completion of the operating stroke (prior to inflection point 'b') allowing the kinetic energy built up in the armature to carry the armature into the desired embossing action. As the battery is used, however, a longer duration power application may be needed until at the end of the useful life of the battery, power application during the entire operating stroke is needed, i.e. up to inflection point 'b.'

Figure 7:
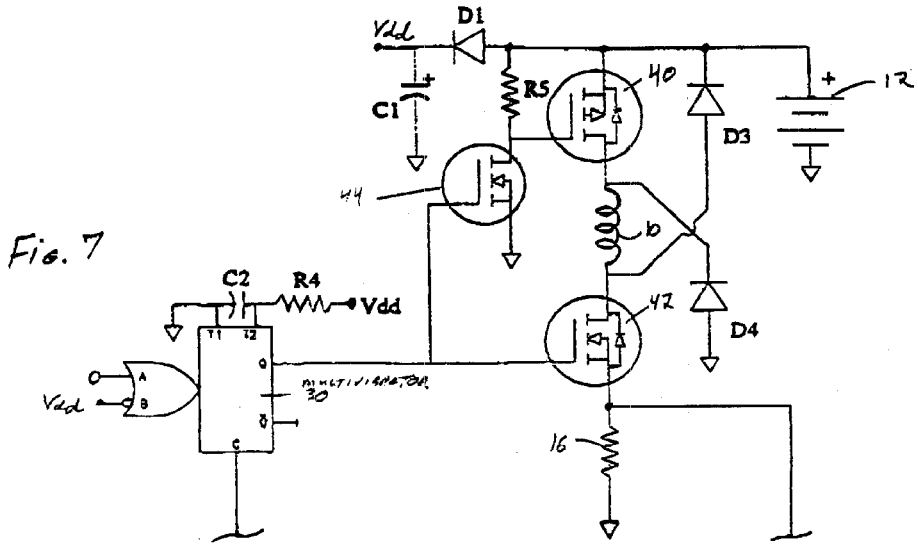
FIG. 7 is an electrical circuit diagram of a modification of the FIG. 5 embodiment in which current is fed back to the operating battery.

The application of a suitable microprocessor as computer 18 and suitable programming to monitor the voltage drop across sensing resistor 16 and to control the operation of power transistor 14 would be well known to those of ordinary skill in the art in view of this disclosure. Additionally, as illustrated in FIG. 7, the computer 18 could also utilize a pair of power transistors 40, 42 which isolate coil 10 and the additional diode circuitry (D3 and D4) such that instead of diode 20 converting current generated by the collapsing coil field into heat which is wasted, the current can be fed back to the solenoid operating power supply, i.e. battery 12. The details of this circuitry are shown in FIG. 7, but would be applicable to the computer implementation shown in FIG. 4.

Figure 5:
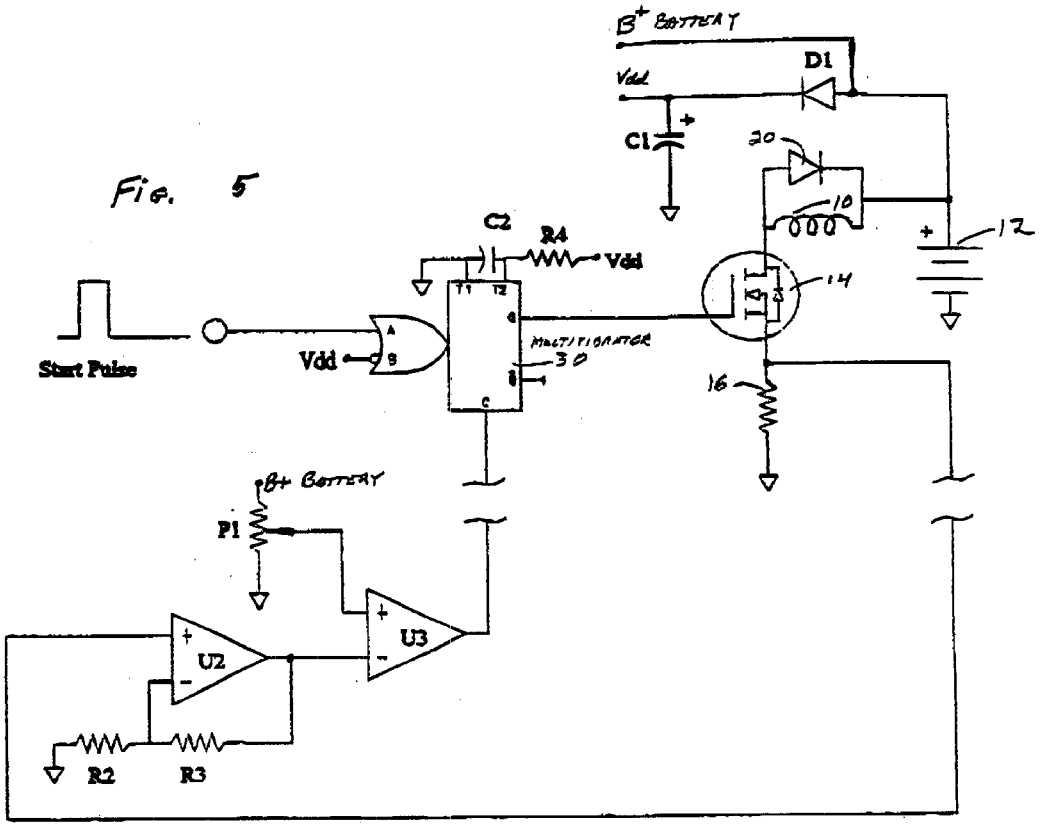
FIG. 5 is an electrical circuit diagram of a current comparator embodiment of the present invention.

FIG. 5 is an electrical schematic for another embodiment of a power saving circuit which, although much more simplified than the microprocessor implemented embodiment shown in FIG. 4, will nonetheless provide an approximation of the inflection point and thereby provide substantial power savings with respect to the solenoid operating power supply.

A preferred embodiment of the simplified system shown in FIG. 5 uses the measurement of a coil current Y which is greater than the maximum coil current X during the armature operating stroke to determine time point "b" (in FIG. 1) and thus is an approximation of the inflection point 'b.' A monostable multivibrator 30 provides an output at time "0" which is connected to the control base of power transistor 14. In a broad sense the power transistor 14 and the multivibrator 30 form an interrupt circuit. A characteristic of a multivibrator is that with an input start pulse, it will produce an output pulse having a predetermined duration as determined by the RC time constant of resistor R4 and capacitor C2, as shown.

Note that in both FIGS. 5 and 7, the circuit interconnections to the filtered power supply point "Vdd" are not shown in order to simplify the drawing. However, point Vdd comprises the voltage at battery 12 (identified as B+Battery), but filtered by diode D1 and capacitor C1 to smooth out variations in battery voltage caused by energization and de-energization of coil 10.

As shown in FIG. 5, a start pulse is supplied to the NAND gate which causes the multivibrator 30 to provide an "on" output having a predetermined duration. As noted above, it may be desirable to set this duration to the longest operating time of the solenoid based upon the solenoid's operating characteristics and the minimum useful voltage from battery 12 (in the embodiment of a Braille printer, this would be 10 milliseconds). Unless the output of the multivibrator 30 is interrupted by an interrupt signal at reset input "c", power transistor 14 will be driven into conduction for the full contingency pulse period of time.

The connections with the signal indicative of current flow through the coil, i.e., the voltage drop across sensing resistor 16 and the interrupt signal to the reset input "c" of multivibrator 30 are shown as being broken in FIG. 5. This is because the comparator circuitry illustrated in FIG. 5 is equally applicable to the embodiment shown in FIG. 7 and, therefore, the break in the two connections serves to eliminate the need to illustrate this identical structure in FIG. 7.

The comparator circuit, which is identified by amplifiers U2 and U3, is shown in detail in the lower portion of FIG. 5. The current indicative output from sensing resistor 16 is supplied to first amplifier U2 whose gain is determined by resistors R2 and R3. It is desirable to have the gain of amplifier U2 fixed such that its output voltage will faithfully represent the wave shape of the solenoid coil current without "saturating" the amplifier. The second amplifier is utilized as a voltage comparator. The output of U2 is compared with a preset percentage of the unfiltered supply voltage from potentiometer P1 and the output provided to the reset input "c" of multivibrator 30. In a broad sense the comparator circuit and the resistor comprise the sensing circuit of this embodiment.

Because P1 is connected directly to the battery at the plus terminal (rather than to Vdd which is the filtered battery voltage), the percentage of battery output applied to the "+" input of amplifier U3 will not reflect variations in battery voltage caused by variations in load caused by the coil 10. Thus, when the output voltage from U2 exceeds the percentage of reference voltage from potentiometer P1, the output voltage of amplifier U3 will go low (nearly zero) providing a logical zero on the reset input "c" of the multivibrator 30, which will terminate the multivibrator's "on" pulse thereby turning off power transistor 14 and interrupting current to the solenoid coil.

As discussed with reference to FIG. 1, P1 is adjusted to be a voltage which reflects a coil current Y slightly higher than the maximum coil current X which is achieved during the solenoid operating stroke. Accordingly, even though the termination of the multivibrator pulse may not be at point 'b', it will be relatively close at point "b," thereby effecting substantial power savings in the battery. As a result, the coil current does not continue growing after completion of the solenoid operating current and the coil does not remain on for the full contingency duration set by the RC circuit as discussed above.

Because the voltage appearing across resistor 16, the amplified output of U2 and at potentiometer P1 are all a function of the solenoid operating power supply voltage (battery 12), they are all related as ratios of one another. Thus, as the battery voltage diminishes with use, so does the output of U2 and the bias voltage from P1, thereby maintaining the desired relative preset reference voltage.

Furthermore, it is possible that due to lowered battery voltage, the solenoid performance can deteriorate such that U3 will not cause an early cut-off, in which case the maximum duration pulse (the "contingency pulse") which in a preferred embodiment is 10 milliseconds as determined by the RC time constant of the multivibrator, is applied to power transistor 14.

Figure 6:
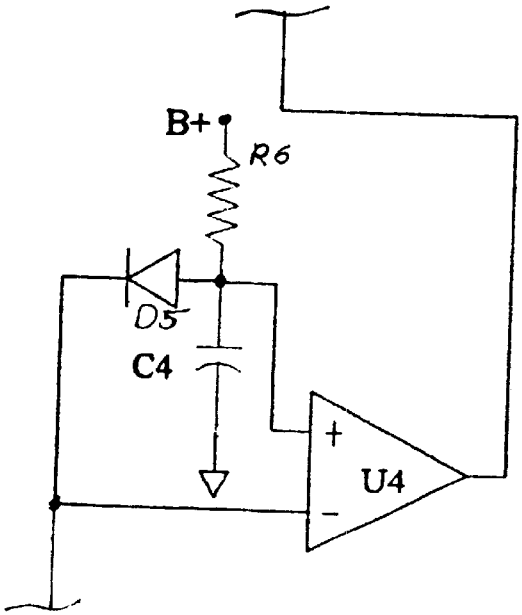
FIG. 6 is an electrical circuit diagram of an additional circuit element which could be added to the circuit of FIG. 5.

FIG. 6 discloses a further improvement to the circuit of FIG. 5. Where the circuit of FIG. 5 provides for a cutoff of the drive pulse at a point slightly after the occurrence of the waveform "cusp" at point 'b,' FIG. 7 illustrates a modification to the FIG. 5 circuitry which provides cutoff at point 'b.' The potentiometer P1 is adjusted to reflect the percentage of the battery voltage when the cusp 'b' is reached (recall that in the normal FIG. 5 embodiment, it was set above the maximum coil current so as to be met only after the solenoid had completed its operating stroke). As a result of this change, the comparison at amplifier U3 will be indicated as the coil current rises from zero when the cusp level voltage is first reached and will be maintained (through the peak coil current and the subsequent decreasing coil current) until the current decreases below the preset P1 level. One would expect such a setting to result in a premature termination of the multivibrator pulse on the rising portion of the coil current curve.

However, the circuitry of FIG. 6 includes a feature which senses the slope of the current curve and only triggers during the decreasing current, thereby ensuring operation at the cusp rather than on the rising current. The output of U3 is provided directly to the inverting input of U4 and through diode D5, to the non-inverting input of U4. The operation is as follows: U4's output is high because its non-inverting input, under static conditions, is higher than its inverting input by the voltage drop across the diode D5. Thus the high output to the input "c" to the multivibrator keeps it enabled prior to the beginning of the "Start" pulse.

The "Start" pulse is initiated and current begins to flow through the solenoid coil in the same manner as in FIG. 5. U2 is set with a high gain so that it saturates early in the current pulse. The high output from U2 exceeds the level set on p1 and thus the comparator U3 goes low. Even though U3 goes low, and the voltage applied to U4 goes low, the voltage at the non-inverting input is slightly above the voltage at the inverting input (due to the voltage on C4 going low but remaining about 0.6 volts higher than the inverting input due to the drop across D5). As a result, the output of U4 remains high.

The solenoid current continues to rise and then fall as before and when it reaches the level set on P1, i.e., that of the cusp 'b', U3 again goes high. At this time, the voltage on the inverting input to U4 (connected directly to the U3 output) exceeds that of the non-inverting input change Parenthetical wording to "(which, due to the blocking diode, D5, sees a relatively slow rising voltage at capacitor C4, as sourced through resistor R6, and whole magnitude is less than that at the inverting input)" and thus the output of U4 goes low momentarily, terminating the multivibrator 30 pulse to the transistor 14. The termination of the coil current causes U2 to go low, thereby resetting U3 and U4 again goes high in preparation for the next pulse.

It can be seen that the ability of the FIG. 6 circuit modification to terminate solenoid current flow at the cusp 'b' saves the additional current which would otherwise be spent in rising to the level "y" in FIGS. 1–3. The improvement of FIG. 6 would be equally applicable to the embodiments shown in both FIG. 5 (and the further power saving feature of FIG. 7). The operation of the circuit is similar to FIG. 5, with the exception of the manner in which the monitored current is processed by the operational amplifier U4 and the setting of P1 as noted above. The improvement of FIG. 6 would result in additional power savings over that shown in FIG. 5.

FIG. 7 discloses an additional embodiment of the present invention in which the benefits of the circuit in FIG. 5 (as shown or as modified by the additional circuitry of FIG. 6) are combined with additional circuitry to provide a current charging path for the battery to be charged with a charging pulse resulting from the collapsing magnetic field around the solenoid coil. It will be recalled that in the embodiments of FIGS. 4 & 5, this energy was expended in the form of heat dissipated in diode 2 and the resistance of the coil.

The significant difference from FIG. 5 is that in FIG. 6 a first power transistor 40 and a second power transistor 42 sandwich coil 10 therebetween and isolate the coil when the transistors are off. The power transistor/coil/ power transistor "sandwich" is in series between battery 12 and circuit ground with the sensing resistor 16 included on one side or the other of the sandwich (it is understood that the sensing resistor could also be located between first power transistor 40 and diode D3, although this would require a separate power supply to the filtering circuit represented by D1 and C1).

In a preferred embodiment, the first power transistor 40 is a P channel transistor, whereas the second power transistor is an N channel transistor. Because the pulse cutting off a P channel transistor requires the opposite polarity from that cutting off conduction of an N channel transistor, a separate N channel transistor 44 is provided for ensuring that the gate of the P channel power transistor 40 goes high, thereby interrupting conduction at the same time that the gate of second power transistor 42 goes low and terminates its conduction.

As will be apparent, when both power transistors 40 and 42 cease conduction (in response to the output of U3 going low and providing a logical zero to the reset input "c" of multivibrator 30), coil 10 will have already built up a substantial magnetic flux field and the operating stroke of the solenoid armature may have been completed. With conduction of the power transistors interrupted and no further movement of the solenoid armature, the magnetic field will collapse attempting to maintain current flow through the coil.

The collapsing field generated current flow will be up from ground, through diode D4, down through coil 10, up through coil D3 and back into battery 12. Thus, the self-generating current of the solenoid is forced back into the battery, providing a small but significant charging pulse. Diodes D3 and D4 comprise in a broad sense, a current charging path. This charging current is equal to the coil current at the instant of cut-off, but declines to zero exponentially over a period of time determined by the solenoid inductance and the impedance of the involved circuitry. Over several thousands of electrical pulses from the battery, this power consumption conservation is both measurable and beneficial.

While the subject matter shown in FIGS. 4, 5 and 6 are shown with a positive battery terminal connected to the various circuit elements, it will be well known to those of ordinary skill in the art that the battery polarity could be reversed and suitable reverse polarity components could be utilized to provide a similar result.

It will be apparent to those having ordinary skill in the art in view of the above discussion and reference to figures, that there will be many modifications and variations of the solenoid current cut-off circuit and/or the charging circuit beyond those which are specifically described and disclosed in this application.

In the microprocessor embodiment, a computer or other electronic device in lieu of the amplifiers and/or logical devices shown in FIGS. 5 and 6, can monitor current through the coil. Any intelligent software routine could monitor current flow through the coil and determine the inflection point at 'b' and send a cut-off command to the associated power transistor. As noted, it may be desirable that, in order to ensure the effectiveness of the solenoid operating stroke, to ensure that the kinetic energy of the armature at impact is the same, regardless of battery voltage. The power input to the coil required to ensure this desirable identical kinetic energy can be measured and then the cutoff time varied so as to ensure the same kinetic energy is imparted to the armature during each pulse.

Additionally, it may be desirable to limit the kinetic energy by terminating the coil pulse "early" i.e. prior to completion of the operating stroke when the battery is fresh and then delay cut-off until inflection point 'b' when the battery reaches the end of its useful life. Instead of a complete early cut-off, it may be desirable to pulse-width-modulate the coil by rapidly turning it on and off to reduce the total coil current prior to a full termination of the energizing pulse, also reducing the kinetic energy of the armature when a fresh battery is being used.

As a result of the above, many variations and embodiments of the present invention will be apparent to those of ordinary skill in the art and the present invention is limited only by the claims appended hereto.

What is claimed is:

1. A power saving circuit for connecting a solenoid operating power supply to a solenoid, wherein said solenoid includes a coil and an armature, said armature having an operating stroke when said coil is energized, wherein during energization, current through said coil varies as a function of armature position and time and when said armature completes said operating stroke, the function of current flow versus time increases at an inflection point, said circuit comprising:

a sensing circuit for sensing the occurrence of said inflection point and for providing an interrupt signal; and an interrupt circuit, responsive to said sensing circuit interrupt signal, for terminating current flow from said power supply to said coil.

2. A power saving circuit for connecting a solenoid operating power supply to a solenoid, wherein said solenoid includes a coil and an armature, said armature having an operating stroke and varying kinetic energy when said coil is energized, wherein during energization, a voltage is applied to said coil and current through said coil varies as a function of armature position and time, said circuit comprising:

a sensing circuit for sensing the current and voltage applied to said coil and for providing an interrupt signal; and an interrupt circuit, responsive to said sensing circuit interrupt signal, for terminating current flow from said power supply to said coil.

3. A power saving circuit according to claim 1, wherein said sensing circuit comprises:

a coil current sensing circuit; and a microprocessor, responsive to said voltage applied to said coil and coil current sensing circuit and, programmed to provide said interrupt signal when a predetermined kinetic energy of said armature is reached.

4. A power saving circuit according to claim 1, wherein said sensing circuit comprises:

a coil current sensing circuit; and a microprocessor, responsive to said coil current sensing circuit, programmed to provide said interrupt signal when the slope of the current versus time curve substantially changes at said inflection point.

5. A power saving circuit according to claim 4, wherein said coil current sensing circuit comprises a resistor in series with said coil and the voltage drop across said resistor comprises a signal indicative of the current through said coil.

6. A power saving circuit according to claim 1, wherein said interrupt circuit comprises a power transistor in series with said coil, where said interrupt signal is applied to the control gate of the transistor terminating conduction through said transistor.

7. A power saving circuit according to claim 4, wherein said interrupt circuit comprises a power transistor in series with said coil, where said interrupt signal is applied to the control gate of the transistor terminating conduction through said transistor.

8. A power saving circuit according to claim 7, wherein said coil current sensing circuit comprises a resistor in series with said coil and said transistor and the voltage drop across said resistor comprises a signal indicative of the current through said coil.

9. A power saving circuit for connecting a solenoid operating power supply to a solenoid, wherein said solenoid includes a coil and an armature, said armature having an operating stroke when said coil is energized, wherein during energization, current through said coil varies as a function of armature position and time and when said armature completes said operating stroke, the function of current flow versus time increases at an inflection point, said circuit comprising:

a sensing circuit for sensing the occurrence of said inflection point and for providing an interrupt signal, said sensing circuit comprising:

a coil current sensing circuit, wherein said coil current sensing circuit comprises a resistor in series with said coil and the voltage drop across said resistor comprises a signal indicative of the current through said coil; and a microprocessor, responsive to said coil current sensing circuit, programmed to provide said interrupt signal when the slope of the current versus time curve substantially changes at said inflection point; and an interrupt circuit, responsive to said sensing circuit interrupt signal, for terminating current flow from said power supply to said coil, wherein said interrupt circuit comprises a power transistor in series with said coil, where said interrupt signal is applied to the control gate of the transistor terminating conduction through said transistor.

10. A power saving circuit according to claim 9, further including said microprocessor programmed to provide an initial "on" pulse to said control gate of said transistor to initiate conduction through said coil.

11. A power saving circuit according to claim 10, wherein said solenoid operated power supply is a battery, and said battery voltage applied to said coil decreases with repeated operation of said solenoid to a lowest operating voltage, said microprocessor provides an "off" pulse to said control gate a predetermined time duration after said "on" pulse, regardless of whether an interrupt pulse has occurred, wherein the time duration from said "on" pulse to said "off" pulse is no longer than the maximum amount of time required for the armature to complete its operating stroke at said lowest operating voltage.

12. A power saving circuit according to claim 11, wherein said time duration is 10 milliseconds.

13. A power saving circuit according to claim 1, wherein said sensing circuit comprises:

a coil current sensing circuit for providing an output indicative of current flow through said coil; and a comparator, responsive to said current indicative output of said sensing circuit, for providing said interrupt signal when said current indicative output exceeds a maximum coil current during said operating stroke.

14. A power saving circuit according to claim 1, wherein said interrupt circuit includes:

at least one power transistor in series with said coil and said power supply; and a monostable multivibrator, said multivibrator, responsive to a start signal, for providing an "on" pulse to said at least one power transistor, allowing current to flow through said transistor and said coil, and an "off" pulse to said at least one power transistor terminating current flow through said transistor and said coil after a time duration equal to a maximum time for said operating stroke based upon a minimum power supply voltage, said multivibrator including an interrupt input interrupting said "on" pulse whenever said interrupt signal is applied to said interrupt input.

15. A power saving circuit for connecting a solenoid operating power supply to a solenoid, wherein said solenoid includes a coil and an armature, said armature having an operating stroke when said coil is energized, said circuit comprising:

a coil current sensing circuit for providing an output indicative of current flow through said coil;

a power transistor in series with said coil and said power supply;

a monostable multivibrator, said multivibrator, responsive to a start signal, for providing an "on" pulse to said power transistor, allowing current to flow through said transistor and said coil, and terminating said "on" pulse to said power transistor terminating current flow through said transistor and said coil after a preset time duration, said multivibrator including an interrupt input interrupting said "on" pulse whenever an interrupt signal is applied to said interrupt input; and a comparator, responsive to said current indicative output of said sensing circuit, for providing said interrupt signal when said current indicative output exceeds a maximum coil current during said operating stroke.

16. A power saving circuit according to claim 15, wherein said sensing circuit comprises a resistor in series with said power transistor and said coil, and the voltage drop across said transistor is said current indicative output.

17. A power saving circuit according to claim 15, wherein said comparator comprises:

a first amplifier having a gain and responsive to said current indicative output, said first amplifier having an output representing a wave shape of current through said coil; and a second amplifier responsive to said first amplifier output and responsive to a reference voltage for providing an interrupt signal output when said first amplifier output exceeds said reference signal.

18. A power saving circuit according to claim 15, wherein said preset time duration in said monostable multivibrator is equal to a maximum time for said operating stroke based upon a minimum power supply voltage.

19. A power saving circuit according to claim 15, wherein said power supply is a battery.

20. A power saving circuit according to claim 1, wherein during energization of said coil, a magnetic field is generated and, when said current flow from said power supply is terminated, said magnetic field collapses inducing a continuing but decreasing current flow through said coil, said circuit further comprising a current charging path providing said battery with charging pulse from said decreasing current flow through said coil.

21. A power saving circuit according to claim 20, wherein said interrupt circuit includes:

first and second power transistors in series with said coil and said power supply, said first power transistor connected between said coil and said power supply and said second power transistor connected between said coil and a circuit ground with current flow during coil energization from said power supply, through said first power transistor, through said coil, through said second power transistor towards circuit ground; and a monostable multivibrator, said multivibrator, responsive to a start signal, for providing an "on" pulse to said two power transistors, allowing current to flow through said transistors and said coil, and an "off" pulse to said two power transistors terminating current flow through said transistors after a time duration equal to a maximum time for said operating stroke based upon a minimum power supply voltage, said multivibrator including an interrupt input interrupting said "on" pulse whenever said interrupt signal is applied to said interrupt input.

22. A power saving circuit according to claim 20, wherein said current charging path is comprised of:

a first diode, said first diode connecting a first junction between the first power transistor and said coil to circuit ground, said first diode permitting current flow from said first junction to said circuit ground; and a second diode, said second diode connecting a second junction between said second power transistor and said coil to said power supply, said second diode permitting current flow from said second junction to said power supply.

23. A power saving circuit for connecting a solenoid operating power supply to a solenoid, wherein said solenoid includes a coil and an armature, said armature having an operating stroke when said coil is energized, wherein during energization of said coil, a magnetic field is generated and, when said current flow from said power supply is terminated, said magnetic field collapses inducing a continuing but decreasing current flow through said coil, said circuit comprising:

a coil current sensing circuit for providing an output indicative of current flow through said coil;

first and second power transistors in series with said coil and said power supply, said first power transistor connected between said coil and said power supply and said second power transistor connected between said coil and a circuit ground with current flow during coil energization from said power supply, through said first power transistor, through said coil, through said second power transistor towards circuit ground; and a monostable multivibrator, said multivibrator, responsive to a start signal, for providing an "on" pulse to said two power transistors, allowing current to flow through said transistors and said coil, and terminating said "on" pulse to said two power transistors terminating current flow through said transistors after a time duration equal to a maximum time for said operating stroke based upon a minimum power supply voltage, said multivibrator including an interrupt input interrupting said "on" pulse whenever said interrupt signal is applied to said interrupt input;

a comparator, responsive to said current indicative output of said sensing circuit, for providing said interrupt signal when said current indicative output exceeds a maximum coil current during said operating stroke; and a current charging path providing said battery with charging pulse from said decreasing current flow through said coil when current flow through said transistor has been interrupted.

24. A power saving circuit according to claim 23, wherein said current charging path is comprised of:

a first diode, said first diode connecting a first junction between the first power transistor and said coil to circuit ground, said first diode permitting current flow from said first junction to said circuit ground; and a second diode, said second diode connecting a second junction between said second power transistor and said coil to said power supply, said second diode permitting current flow from said second junction to said power supply.

25. A power saving circuit according to claim 23, wherein said coil current sensing circuit comprises a resistor in series with said coil connected between said second power transistor and circuit ground, and the voltage drop across said resistor comprises a signal indicative of the current through said coil.

26. A power saving circuit according to claim 23, wherein said power supply is a battery.

27. A power saving circuit for connecting a solenoid operating power supply to a solenoid, wherein said solenoid includes a coil and an armature, said armature having an operating stroke when said coil is energized, said circuit comprising:

a coil current sensing circuit for providing an output indicative of current flow through said coil;

a power transistor in series with said coil and said power supply;

a monostable multivibrator, said multivibrator, responsive to a start signal, for providing an "on" pulse to said power transistor, allowing current to flow through said transistor and said coil, and terminating said "on" pulse to said power transistor terminating current flow through said transistor and said coil after a preset time duration, said multivibrator including an interrupt input interrupting said "on" pulse whenever an interrupt signal is applied to said interrupt input; and a comparator, responsive to said current indicative output of said sensing circuit, for providing said interrupt signal when said current indicative output reaches a predetermined limit, wherein said comparator includes a first amplifier having a gain and responsive to said current indicative output, said first amplifier having an output representing a wave shape of current through said coil;

a second amplifier responsive to said first amplifier output and responsive to a reference voltage for providing an interrupt signal output when said first amplifier output meets said reference signal; and a third amplifier, said third amplifier having an inverting input and a non-inverting input, said inverting input directly responsive to said second amplifier output and said non-inverting input responsive to said second amplifier output through a diode, said output signal from said second amplifier indicative of a decreasing coil current reaching said predetermined limit resulting in the third amplifier providing an interrupt signal to said multivibrator.

28. A power saving circuit according to claim 27, wherein said predetermined limit is a percentage of the power supply voltage.

29. A power saving circuit according to claim 27, wherein said power supply is a battery and said predetermined limit is set by a potentiometer supplied by the battery.

30. A power saving circuit according to claim 27, wherein said predetermined limit is set by a potentiometer supplied by the power supply.

* * * * *